US011885183B2

(12) United States Patent
Fox

(10) Patent No.: US 11,885,183 B2
(45) Date of Patent: Jan. 30, 2024

(54) DOWNHOLE INDUCTIVE COUPLER WITH INGOT

(71) Applicant: Joe Fox, Spanish Fork, UT (US)

(72) Inventor: Joe Fox, Spanish Fork, UT (US)

( * ) Notice: Subject to any disclaimer, the term of this patent is extended or adjusted under 35 U.S.C. 154(b) by 148 days.

(21) Appl. No.: 17/718,910

(22) Filed: Apr. 12, 2022

(65) Prior Publication Data

US 2022/0235615 A1 Jul. 28, 2022

(51) Int. Cl.
*E21B 17/02* (2006.01)
*E21B 47/13* (2012.01)

(52) U.S. Cl.
CPC ..... *E21B 17/0283* (2020.05); *E21B 47/13* (2020.05)

(58) Field of Classification Search
CPC .... E21B 47/13; E21B 17/0283; E21B 17/028; E21B 17/0285
See application file for complete search history.

(56) References Cited

U.S. PATENT DOCUMENTS

2004/0104797 A1* 6/2004 Hall ..... E21B 17/028 336/132
2005/0001738 A1* 1/2005 Hall ..... E21B 47/13 340/854.8
2008/0083529 A1* 4/2008 Hall ..... F16L 15/08 166/66
2016/0049718 A1* 2/2016 Mueller ..... B22D 19/04 343/720

FOREIGN PATENT DOCUMENTS

CA 3118803 A1 * 6/2020 ..... C21D 6/004

* cited by examiner

*Primary Examiner* — Caroline N Butcher

(57) ABSTRACT

An inductive coupler and method for a downhole tool such as a drill pipe comprising an electrically conductive ingot cast into a magnetically conducting electrically insulating (MCEI) annular mold. The MCEI mold may comprise an annular channel comprising a first perforation and one or more second perforations. The ingot may comprise first and seconds with sockets proximate the respective ends. The first perforation may comprise an electrical connection to a ground pin in the downhole tool. The one or more second perforations may comprise electrical connections to a similarly configured ingot within the downhole tool and to electrical equipment within the drill pipe. The ingot may further comprise cleats and flutes. The ingot may comprise an annular passageway around the interior of the ingot. The ingot may be sealed within the channel and each of the perforation may comprise a seal insolating the electrical connections from the downhole environment.

20 Claims, 14 Drawing Sheets

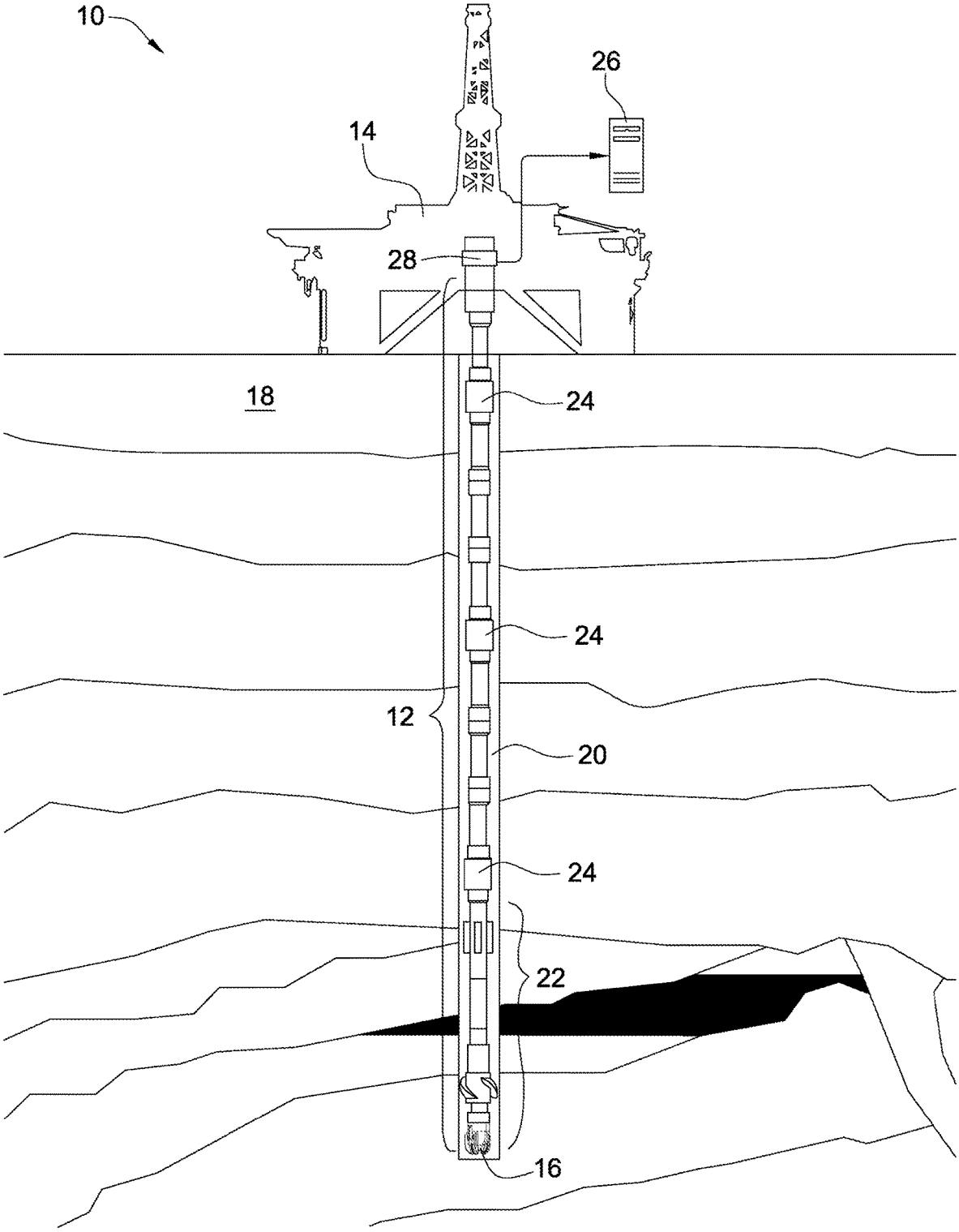
(Prior Art) FIG. 6

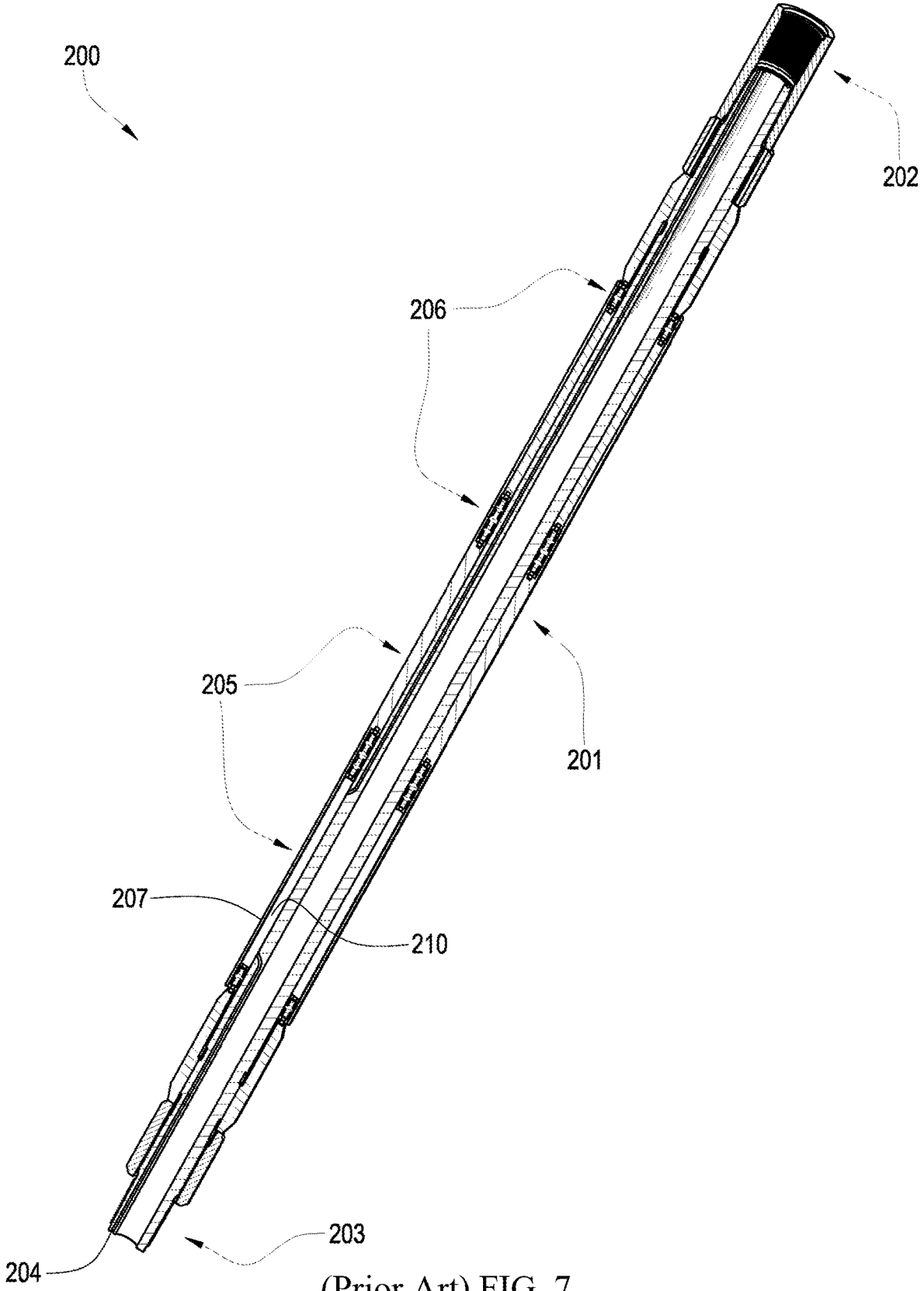
(Prior Art) FIG. 7

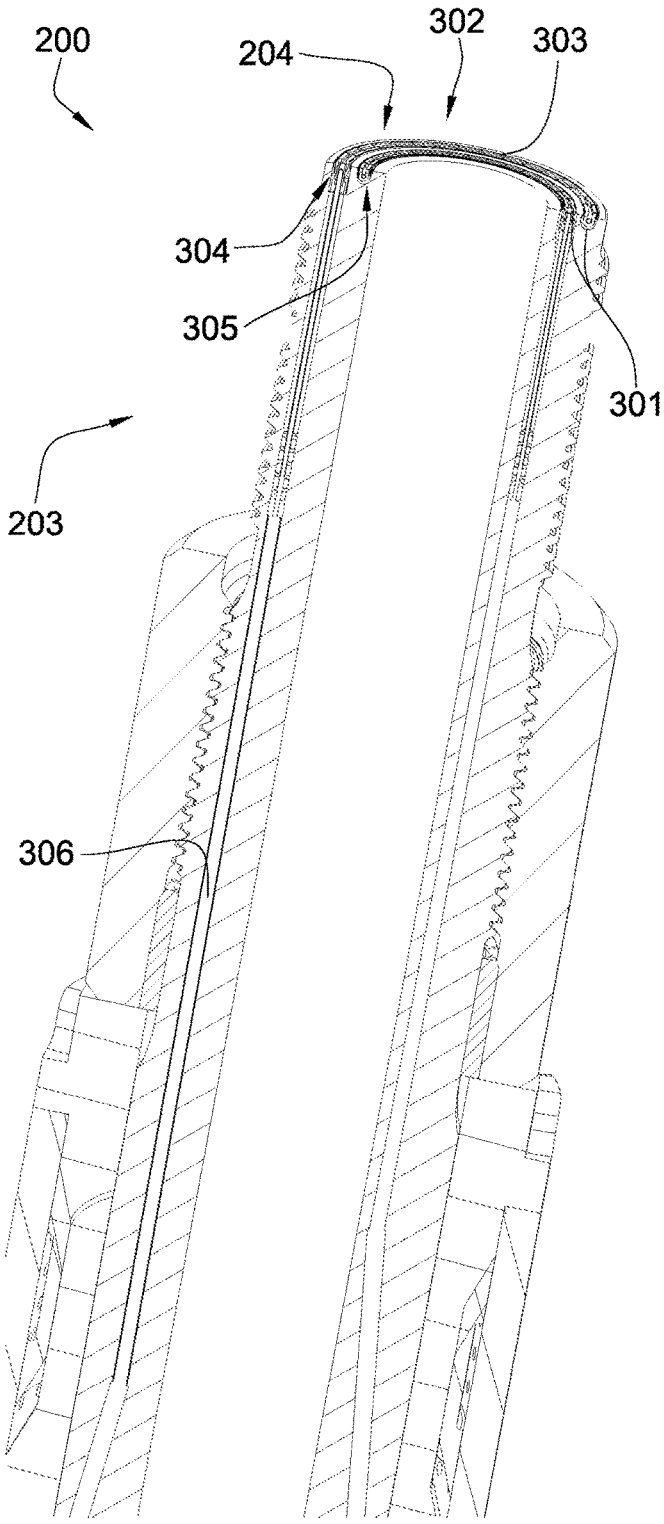
(Prior Art) FIG. 8
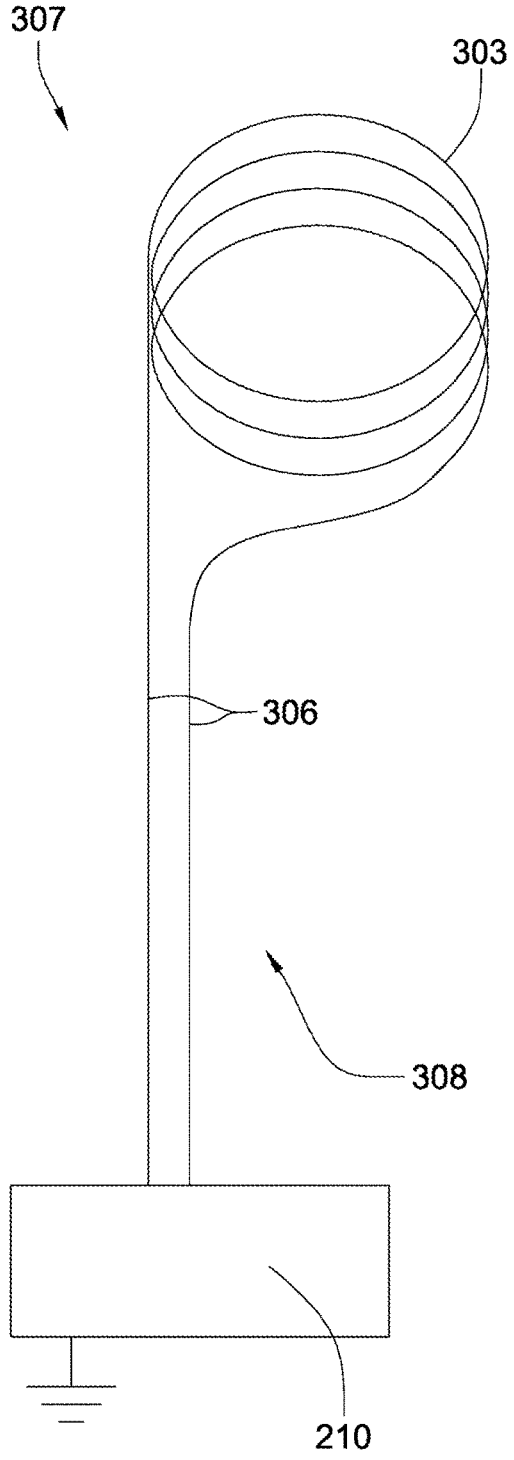
(Prior Art) FIG. 8A

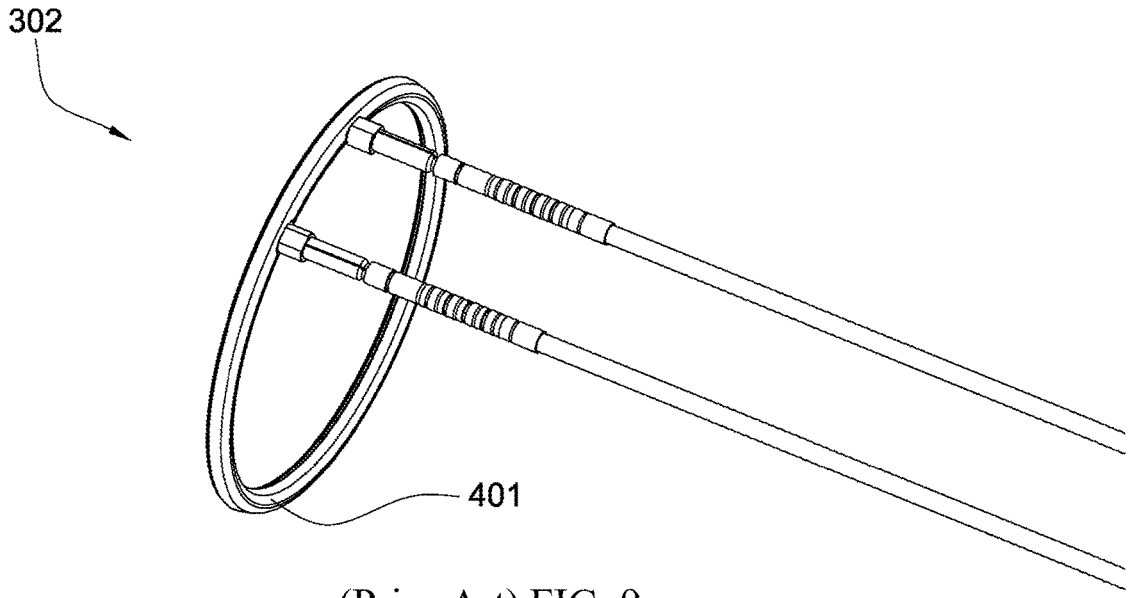
(Prior Art) FIG. 9
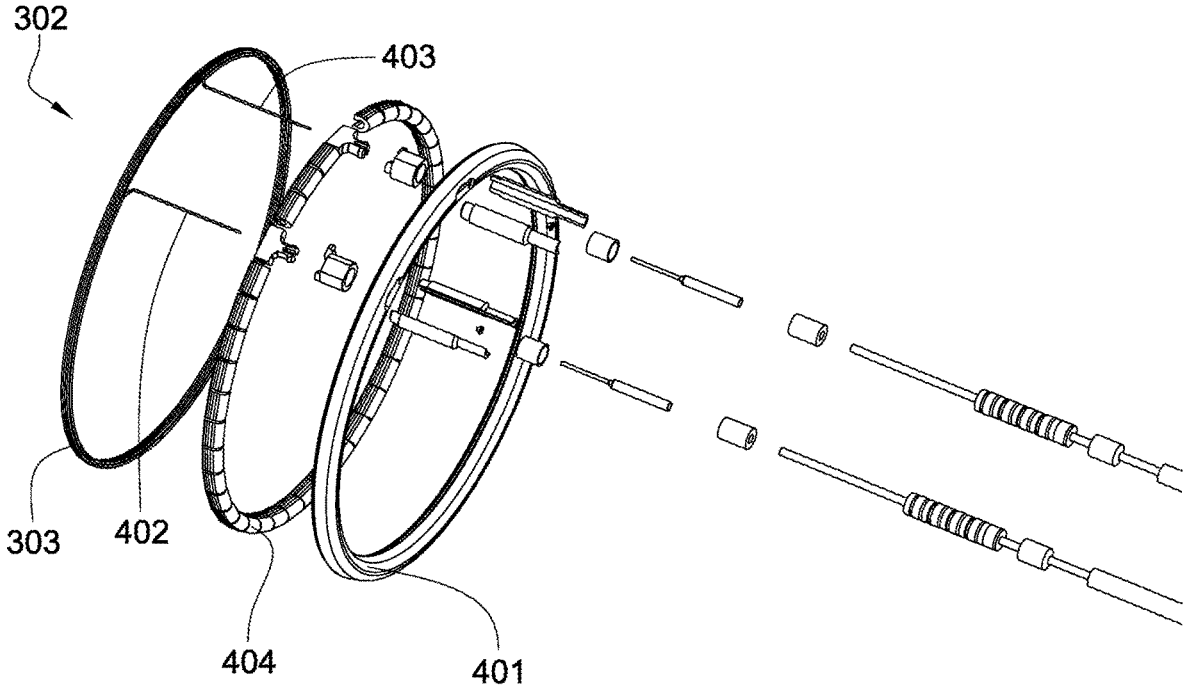
(Prior Art) FIG 10

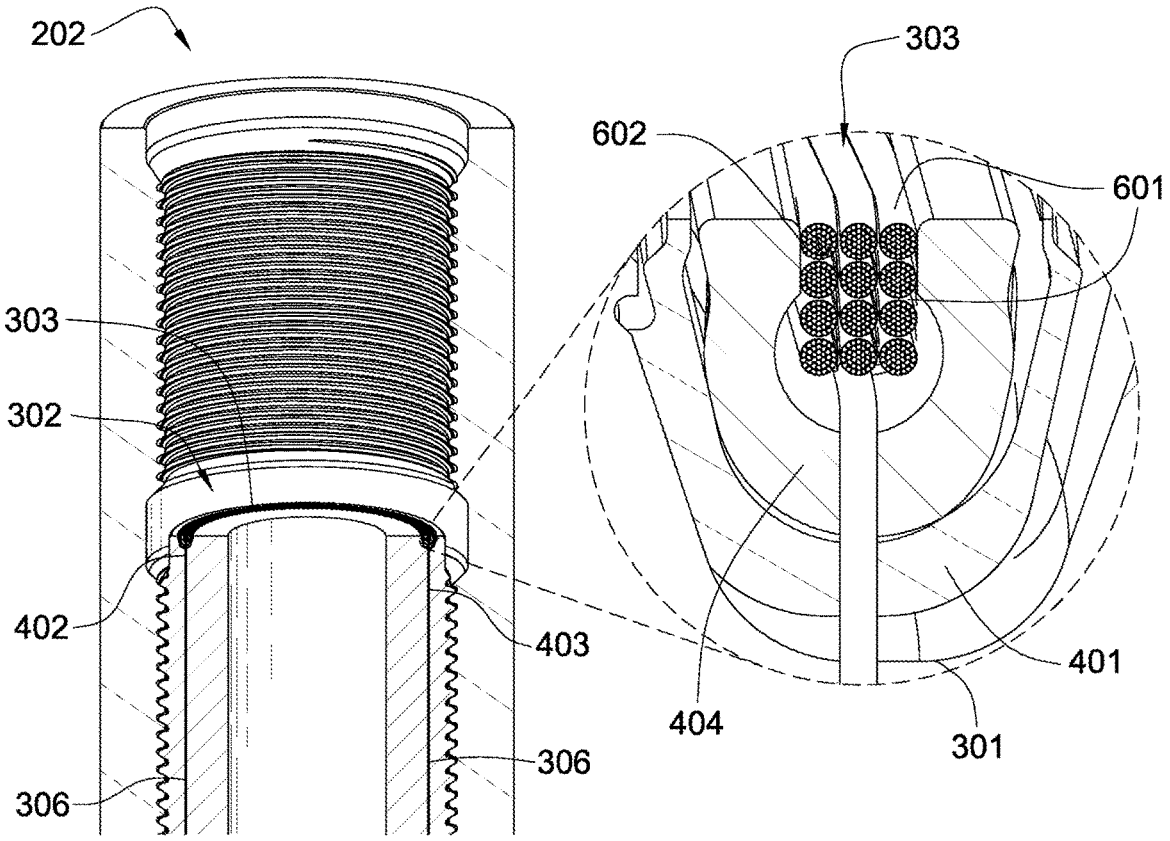
(Prior Art) FIG. 11
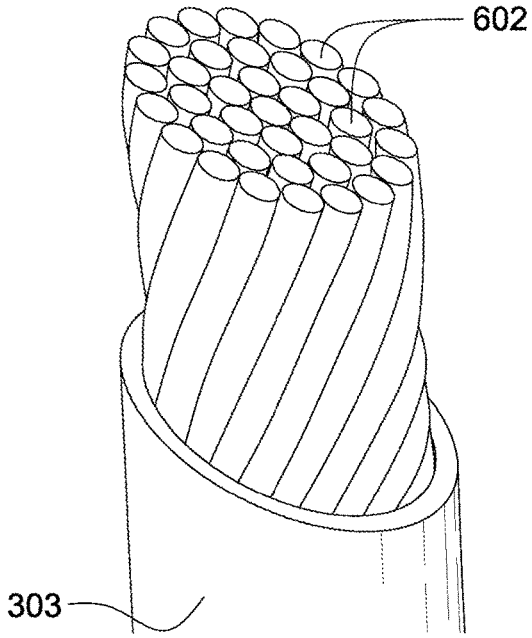
(Prior Art) FIG. 12
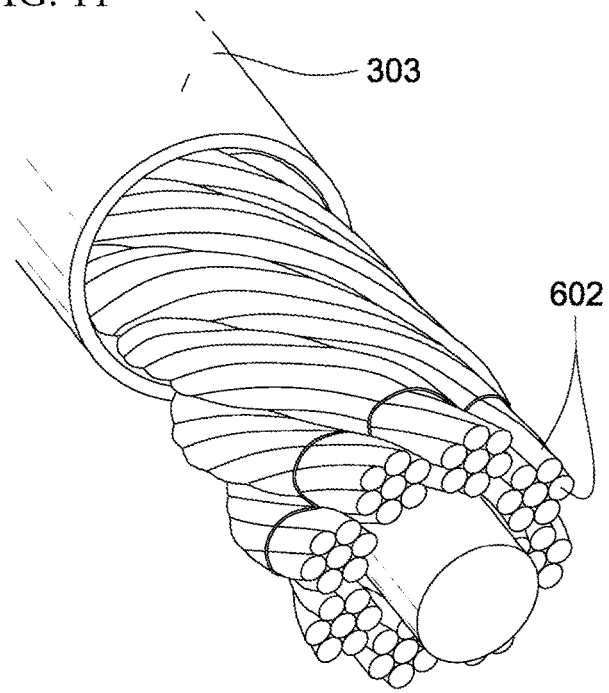
(Prior Art) FIG. 13

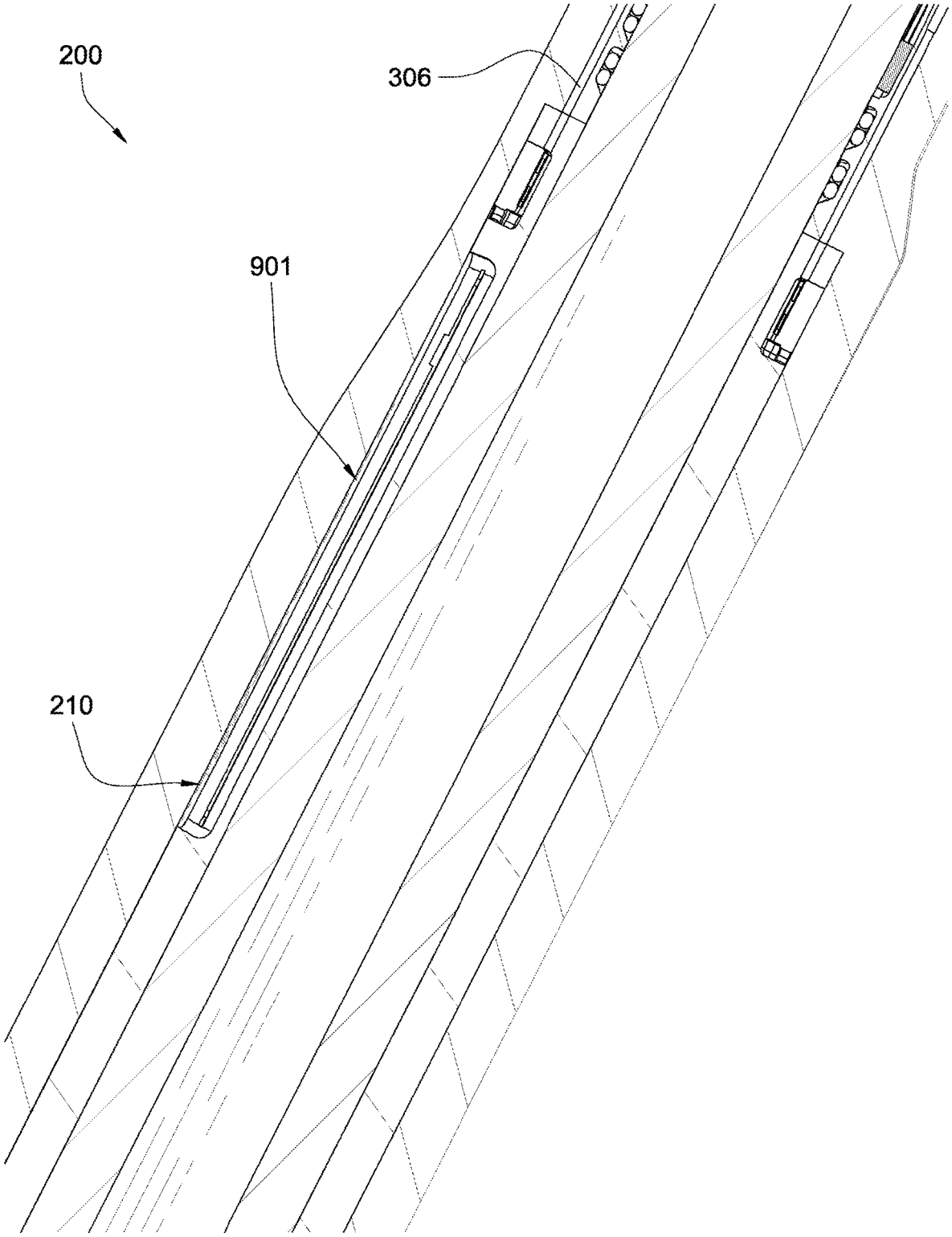
(Prior Art) FIG. 14

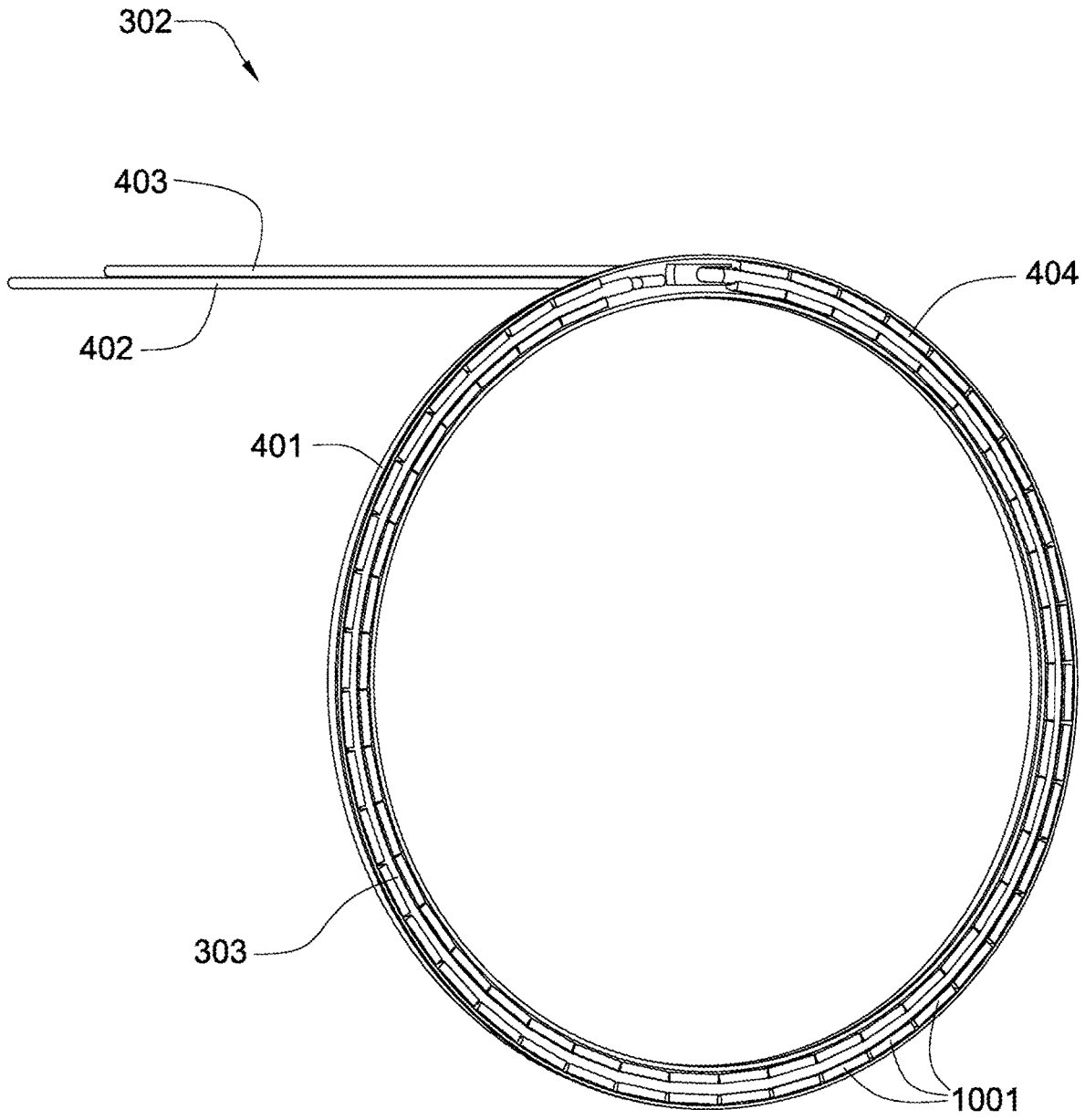
(Prior Art) FIG. 15

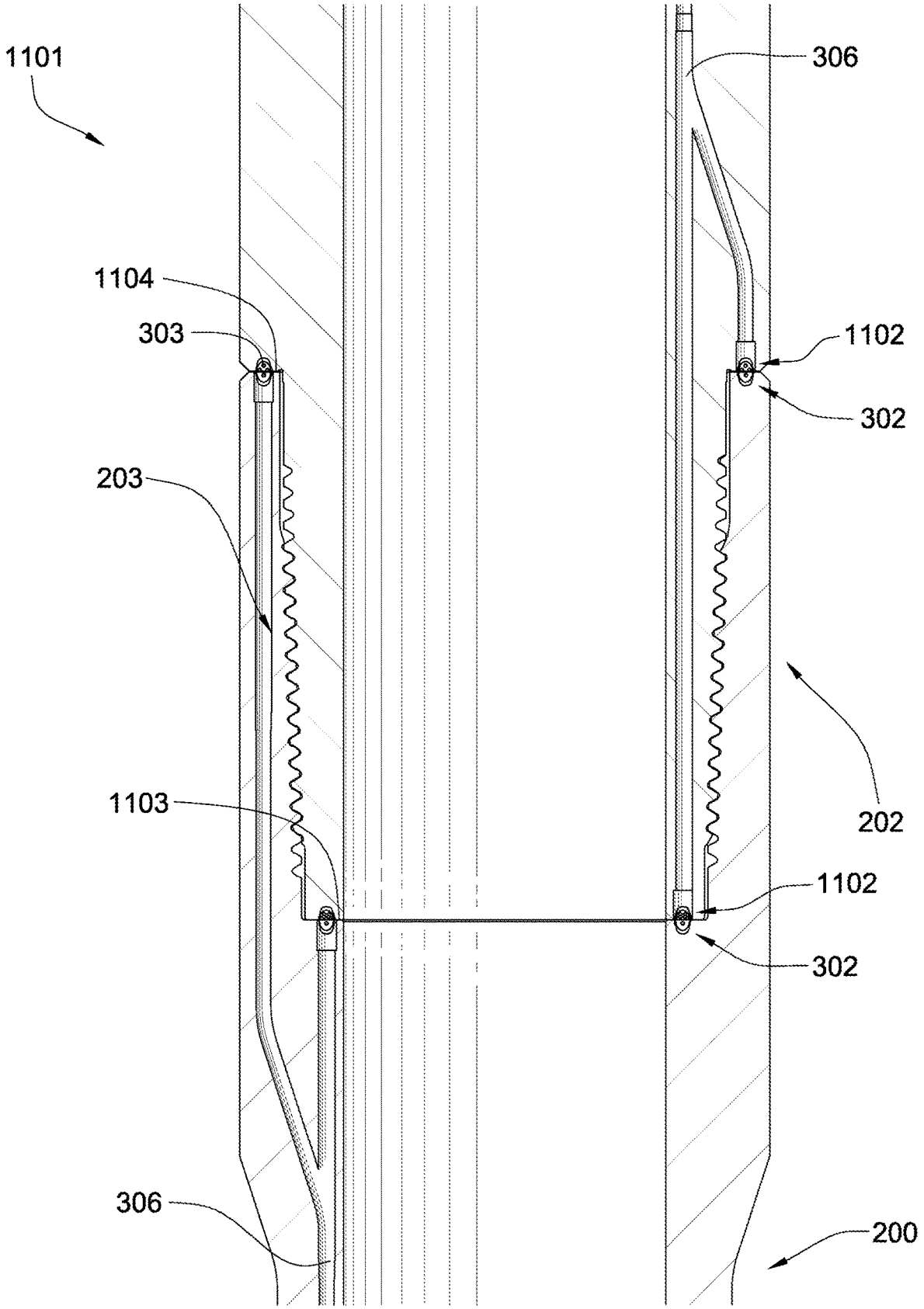
(Prior Art) FIG. 16

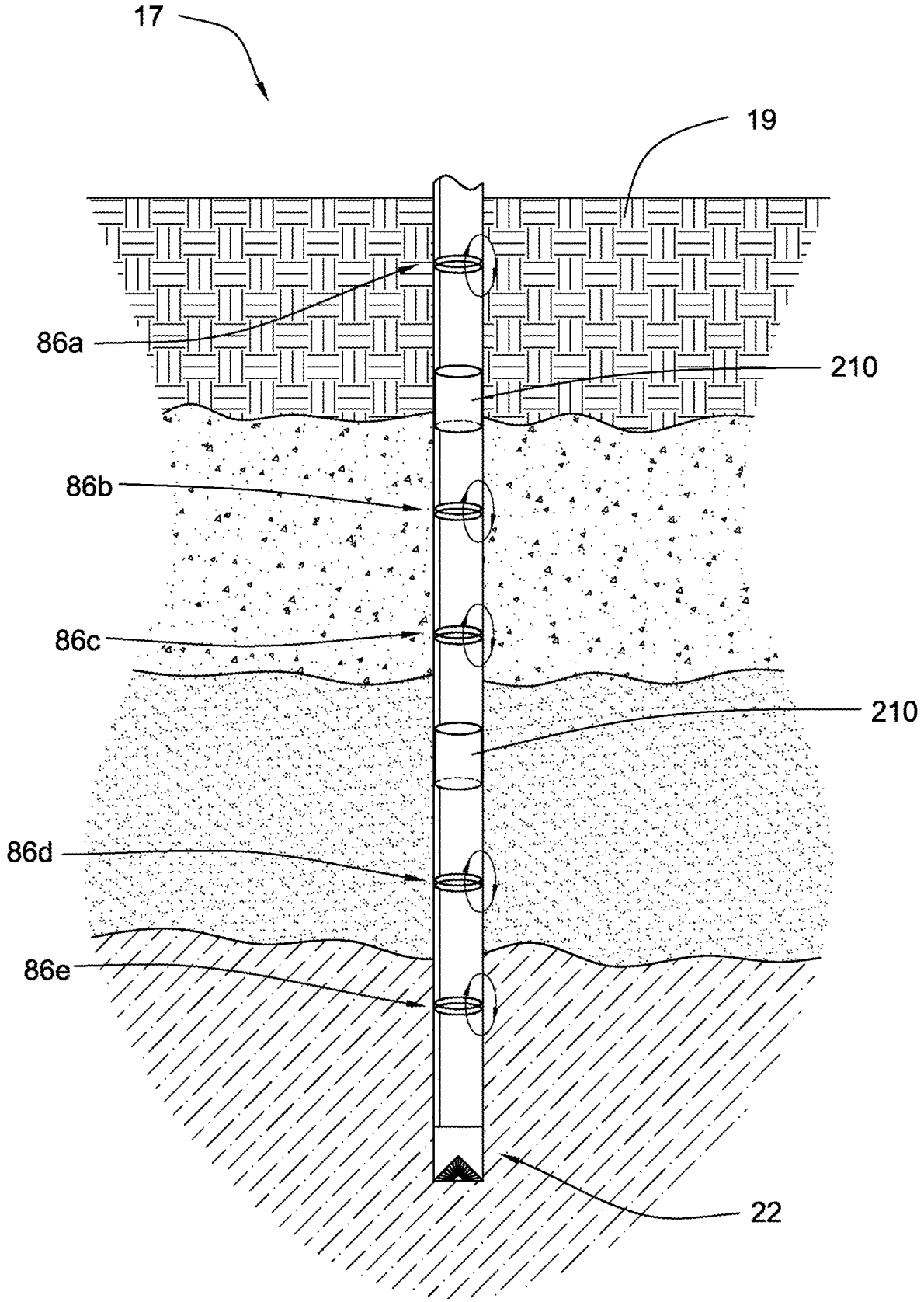
(Prior Art) FIG. 17

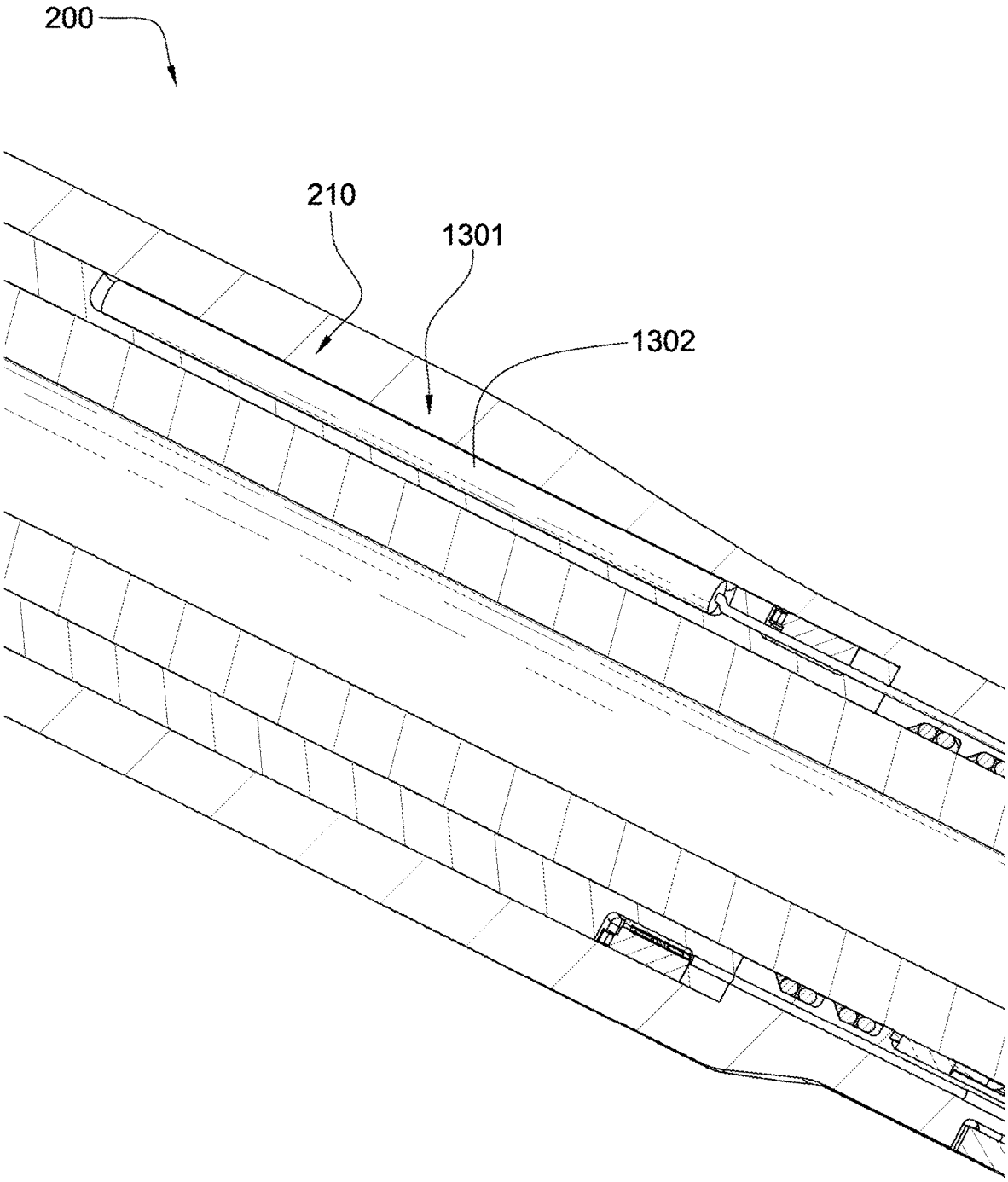
(Prior Art) FIG. 18

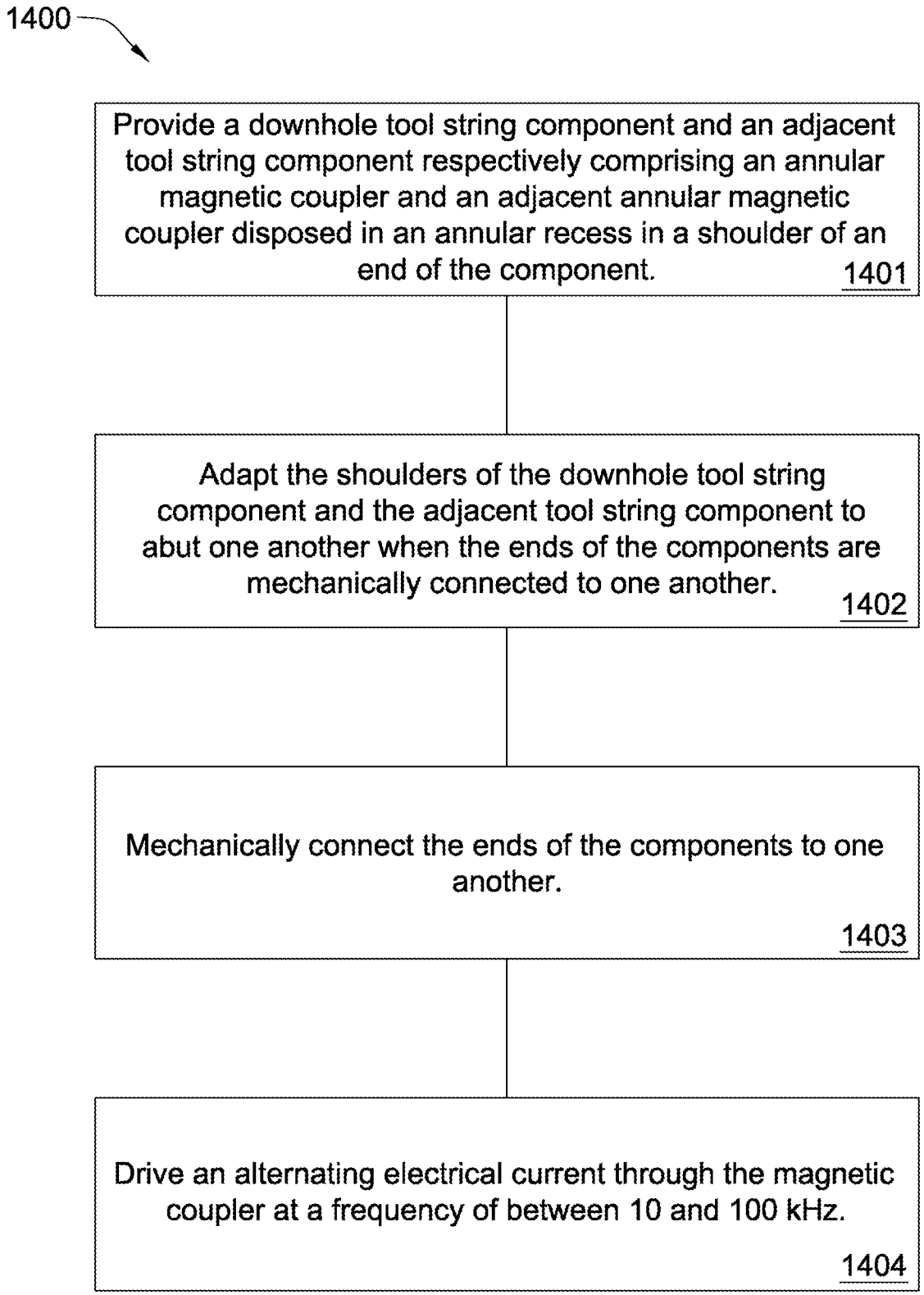
(Prior Art) FIG. 19

DOWNHOLE INDUCTIVE COUPLER WITH INGOT

RELATED APPLICATIONS

The present application presents an alteration and modification of U.S. Pat. No. 8,519,865, to Hall et al., entitled Downhole Coils, issued Aug. 27, 2013, which is incorporated herein by this reference.

U.S. Pat. No. 6,670,880, to Hall et al., entitled Downhole Data Transmission System, issued Dec. 30, 2003, is incorporated herein by this reference.

BACKGROUND

The present invention relates to downhole drilling, and more particularly, to systems and methods for transmitting power and data to components of a downhole tool string. Downhole sensors, tools, telemetry components and other electronic components continue to increase in both number and complexity in downhole drilling systems. Because these components require power to operate, the need for a reliable energy source to power these downhole components is becoming increasingly important. Constraints imposed by downhole tools and the harsh downhole environment significantly limit options for delivering power and data to downhole components.

As downhole instrumentation and tools have become increasingly more complex in their composition and versatile in their functionality, the need to transmit power and/or data through tubular tool string components is becoming ever more significant. Real-time logging tools located at a drill bit and/or throughout a tool string require power to operate. Providing power downhole is challenging, but if accomplished it may greatly increase the efficiency of drilling. Data collected by logging tools are even more valuable when they are received at the surface real time.

BRIEF SUMMARY

The application presents an alteration and modification to the '865 reference above. A large portion of the summary and detailed description are taken from said reference in relation to the prior art figures. The following portion of the summary relates to FIGS. 1-5 of the present application. The teachings of the '865 reference are applicable to this application except to the extent they are altered or modified by FIGS. 1-5 and related text, abstract and claims.

This application discloses an inductive coupler and a method for producing the inductive coupler for use in a downhole tool such as a drillpipe or bottom hole assembly. The inductive coupler may comprise an annular magnetically conductive electrically insulating (MCEI) U-shaped single piece trough or mold comprising an annular channel. The annular channel may comprise a first perforation and one or more second perforations. Typically, inductive couplers for use in downhole applications may be comprised of multiple MCEI trough segments arranged end for end to form an annular ring-like structure. See (Prior Art) FIG. 15. The MCEI segments may be composed of a ferrite composition. Ferrite may be hard and brittle and susceptible to breakage. The use of segments may enable construction and handling of the MCEI coupler and reduce breakage of the ferrite ring. In this application, a solid ferrite ring may be used. The ferrite trough or MCEI ring may be used as a mold and an annular electrically conducting molten ingot may be cast within the annular channel of the mold. A molten metal comprising metal or a metal alloy may be cast into the MCEI mold producing the electrically conducting ingot. Ferrite segments may be used as a mold, also, by lining the channel with a thin refractory liner, such as a ceramic liner or a titanium, or other metal foil, to prevent molten metal leakage between the segments.

The ingot may comprise a first end and a second end. A first socket may be cast in the ingot adjacent the first end. One or more second sockets may be cast in the ingot adjacent the second end. The sockets may be cast when the ingot is cast in the channel or the sockets may be formed after the ingot is cast by machining. A first perforation and one or more second perforations may be formed in the bottom of the annular channel. The perforations may be formed by machining after the ingot is cast into the channel of the mold. The first perforation may be aligned with the first socket and the one or more second perforations may be aligned with the one or more second sockets. The respective sockets may house electrical connections. The first socket may house an electrical connection to a ground pin in the downhole tool. The one or more second sockets may house electrical connections to cables within the downhole tools. The cables may be connected to electronic equipment in the drill string or downhole tool. One or more cables may be attached to a similarly configured inductive coupler at the opposite end of the drill pipe or within the downhole tool. The alignment of the perforations with the respective sockets allows for cable access through the MCEI mold to the make an electrical connection with the ingot.

The channel in the MCEI mold may comprise one or more cleats projecting into the ingot thereby securing the ingot within the channel. The ingot may comprise one or more cleats projecting into the channel as a means of securing the ingot within the channel. The ingot may comprise annular flutes and the channel also may comprise annular flutes. The annular flutes of the ingot may couple with the annular flutes of the channel. The annular flutes may assist in securing the ingot within the annular channel. Also, the annular flutes may increase the surface area of the ingot thereby increasing the strength of the electromagnetic field between adjacent inductive couplers. The ingot may comprise an annular internal passageway within the ingot. The passageway may contribute resiliency to the ingot. Also, the passageway may promote rigidity in the ingot. An electrical cable may run through the passageway.

A nonelectrically conductive seal may enclose the ingot within the channel. A seal seat may be provided in the wall of the channel to seal the ingot from downhole fluids and to fix the seal over the ingot. The seal may act as a channel filler protecting the ingot from contamination from the downhole environment. Also, seals may be provided for the respective sockets and electrical connections, sealing the ingot and the respective sockets and electrical connections against downhole contamination.

The inductive coupler may be produced by providing an annular MCEI U-shaped mold comprising an annular channel and casting an electrically conductive molten metal or metal alloy into the channel, thereby producing an annular electrically conducting ingot.

The ingot may have a first end and a second end. A first socket may be formed proximate the first end and a second socket may be formed proximate the second end. The respective sockets may be formed when the molten metal is cast into the channel, or the respective sockets may be formed by machining after the ingot is cooled. The ingot may comprise one or more second sockets. The sockets may provide a housing for electrical connections to the ingot.

A first perforation and one or more second perforations may be formed in the channel by machining. The respective perforations may be aligned with the respective sockets. The perforations allow cables within the downhole tool or drill string to access electrical connections in the ingot. The first electrical connection may be to a ground pin within the downhole tool. The one or more electrical connections may be to cables connecting the ingot to a similarly configured ingot at the opposite of the drill pipe. And, the cables may connect the ingot to electronics and electrical equipment within the downhole tool.

Seals may be provided to protect the ingot and electrical connections within the channel. A seal may be provided to cover the ingot within the channel. The channel seal may be partially disposed within annular seal seats formed in the walls of the channel. The respective sockets may be provided with seals to prevent contamination from downhole fluids and debris.

The ingot may be provided with an annular passageway formed within the ingot placing a tubular form in the channel prior to casting in the molten metal. The tubular form may be electrically conductive and remain within the ingot or it may be nonelectrically conductive and consumed in the process.

Cleats and flutes may be formed in the channel and in the ingot. The cleats and flutes may be formed in the channel before it is sintered or machined in after sintering. Also, the flutes and cleats may be formed in the ingot when the ingot is cast into the channel by providing a form in the channel comprising the flutes and cleats. The form may be permanent or may be a consumable.

The following portion of the summary is taken from the '865 reference and applies to the prior art figures incorporated herein. The teachings of the remainder of the summary are applicable to the present application except when altered or modified by the teachings of the FIGS. 1-5 and related text, claims, and abstract.

In one aspect of the invention, a downhole tool string component comprises a tubular body with at least one end adapted for threaded connection to an adjacent tool string component. The at least one end comprises at least one shoulder adapted to abut an adjacent shoulder of an adjacent end of the adjacent tool string component. An annular inductive coupler is disposed within an annular recess formed in the at least one shoulder, and the inductive coupler comprises a coil in electrical communication with an electrical conductor that is in electrical communication with an electronic device secured to the tubular body. The coil comprises a plurality of windings of wire strands that are electrically isolated from one another and which are disposed in an annular trough of magnetic material secured within the annular recess.

The coil wire may comprise a gauge of between 36 and 40 AWG, and may comprise between 1 and 15 coil turns. The coil wire may comprise between 5 and 40 wire strands. The wire strands may be interwoven. The coil may comprise the characteristic of increasing less than 35.degree. Celsius when 160 watts are passed through the coil. In some embodiments the coil may comprise the characteristic of increasing less than 20.degree. C. when 160 watts are passed through the coil.

The adjacent shoulder of the adjacent downhole tool string may comprise an adjacent inductive coupler configured similar to the inductive coupler. These couplers may be adapted to couple together when the downhole components are connected together at their ends. The inductive coupler and the adjacent inductive coupler may then be adapted to induce magnetic fields in each other when their coils are electrically energized. In such embodiments the inductive coupler may comprise a characteristic of transferring at least 85% energy from the inductive coupler to the adjacent inductive coupler when 160 watts are passed through the coil.

The electronic device that is secured to the tubular body may be a power source. The power source may comprise a battery, generator, capacitor, motor, or combinations thereof. In some embodiments the electronic device may be a sensor, drill instrument, logging-while-drilling tool, measuring-while-drilling tool, computational board, or combinations thereof.

The magnetic material may comprise a material selected from the group consisting of ferrite, a nickel alloy, a zinc alloy, a manganese alloy, soft iron, a silicon iron alloy, a cobalt iron alloy, a mu-metal, a laminated mu-metal, barium, strontium, carbonate, samarium, cobalt, neodymium, boron, a metal oxide, rare earth metals, and combinations thereof. The magnetic material may comprise a relative magnetic permeability of between 100 and 20000.

In another aspect of the invention, a method of transferring power from a downhole tool string component to an adjacent tool string component comprises a step of providing a downhole tool string component and an adjacent tool string component. The components respectively comprise an annular inductive coupler and an adjacent annular inductive coupler disposed in an annular recess in a shoulder of an end of the component. The method further comprises adapting the shoulders of the downhole tool string component and the adjacent tool string component to abut one another when the ends of the components are mechanically connected to one another. The method also comprises a step of mechanically connecting the ends of the components to one another and a step of driving an alternating electrical current through the inductive coupler at a frequency of between 10 and 100 kHz. In some embodiments the frequency may be between 50 and 79 kHz. In some embodiments a square wave may be used. The square wave may be a 170-190 volt square wave.

The inductive coupler and the adjacent inductive coupler may be respectively disposed within annular troughs of magnetic material that are disposed within the respective annular recess of the downhole and adjacent components. At least one of the inductive coupler and adjacent inductive coupler may comprise a coil that comprises a plurality of windings of wire strands, the wire strands each being electrically isolated from one another. At least 85% of the energy comprised by the alternating electrical current being driven through the annular inductive coupler may be inductively transferred to the adjacent inductive coupler when 160 watts are passed through the coil. In some embodiments at least 95% of the energy comprised by the alternating electrical current being driven through the annular inductive coupler may be inductively transferred to the adjacent inductive coupler when 160 watts are passed through the coil.

BRIEF DESCRIPTION OF THE DRAWINGS

(Prior Art) FIG. 6 is a cross-sectional view of a formation disclosing an orthogonal view of a tool string.

(Prior Art) FIG. 7 is a cross-sectional diagram of an embodiment of tool string component.

(Prior Art) FIG. 8 is a cross-sectional diagram of another embodiment of a tool string component.

(Prior Art) FIG. 8A is an electrical schematic of an embodiment of an electrical circuit.

(Prior Art) FIG. 9 is a perspective diagram of an embodiment of an inductive coupler.

(Prior Art) FIG. 10 is an exploded diagram of an embodiment of an inductive coupler.

(Prior Art) FIG. 11 is a cross-sectional diagram of an embodiment of an inductive coupler disposed in a tool string component.

(Prior Art) FIG. 12 is a perspective diagram of an embodiment of a coil comprising a plurality of electrically isolated wire strands.

(Prior Art) FIG. 13 is a perspective diagram of another embodiment of a coil comprising a plurality of electrically isolated wire strands.

(Prior Art) FIG. 14 is a cross-sectional diagram of a tool string component having an embodiment of an electronic device.

(Prior Art) FIG. 15 is a perspective diagram of an embodiment of an inductive coupler.

(Prior Art) FIG. 16 is a cross-sectional diagram of an embodiment of a tool string component connected to an adjacent tool string component.

(Prior Art) FIG. 17 is a cross-sectional diagram of a formation showing a tool string having a downhole network.

(Prior Art) FIG. 18 is a cross-sectional diagram of an embodiment of a tool string component having an embodiment of an electronic device.

(Prior Art) FIG. 19 is a flowchart disclosing an embodiment of a method of transferring power between tool string components.

DETAILED DESCRIPTION

Figure 1:
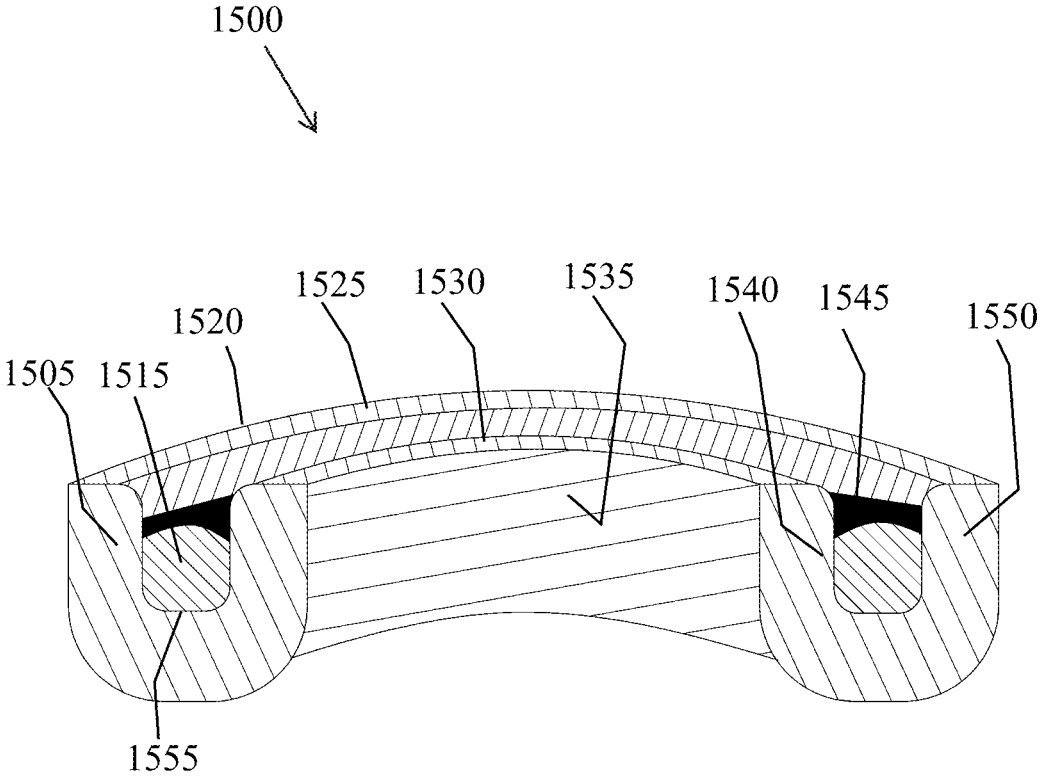
FIG. 1 is a diagram of a half section of an annular mold and ingot of the present invention.
Figure 2:
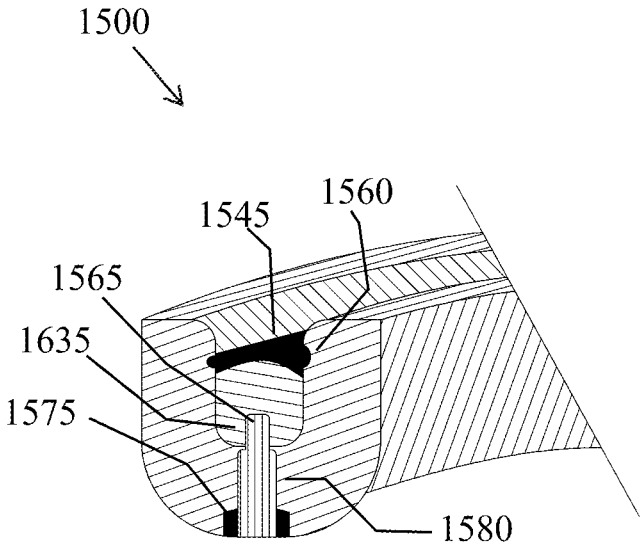
FIG. 2 is a diagram of an end portion of an annular mold and ingot of the present invention.
Figure 3:
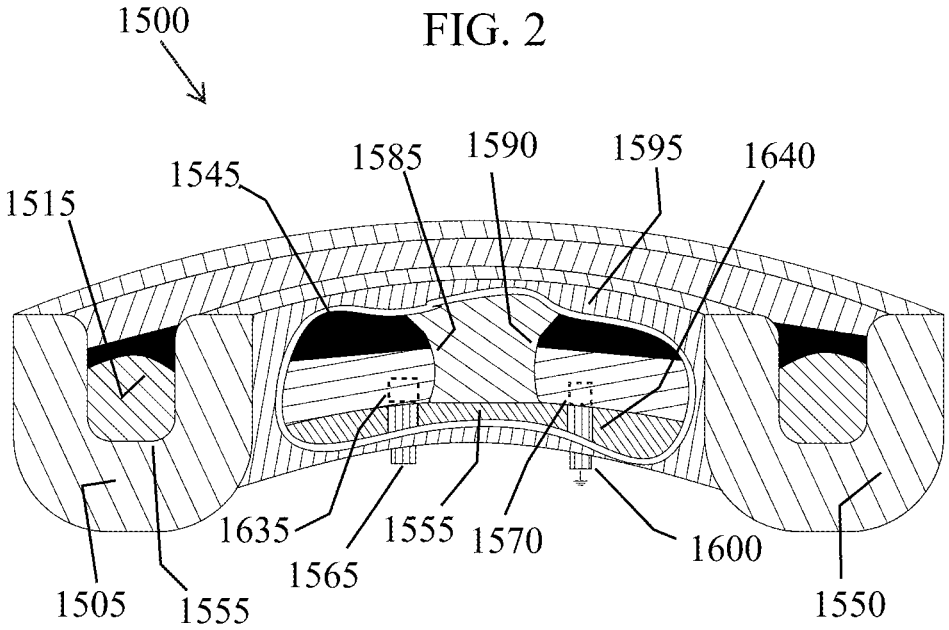
FIG. 3 is a diagram of an interior of a half section of an annular mold and ingot of the present invention.
Figure 4:
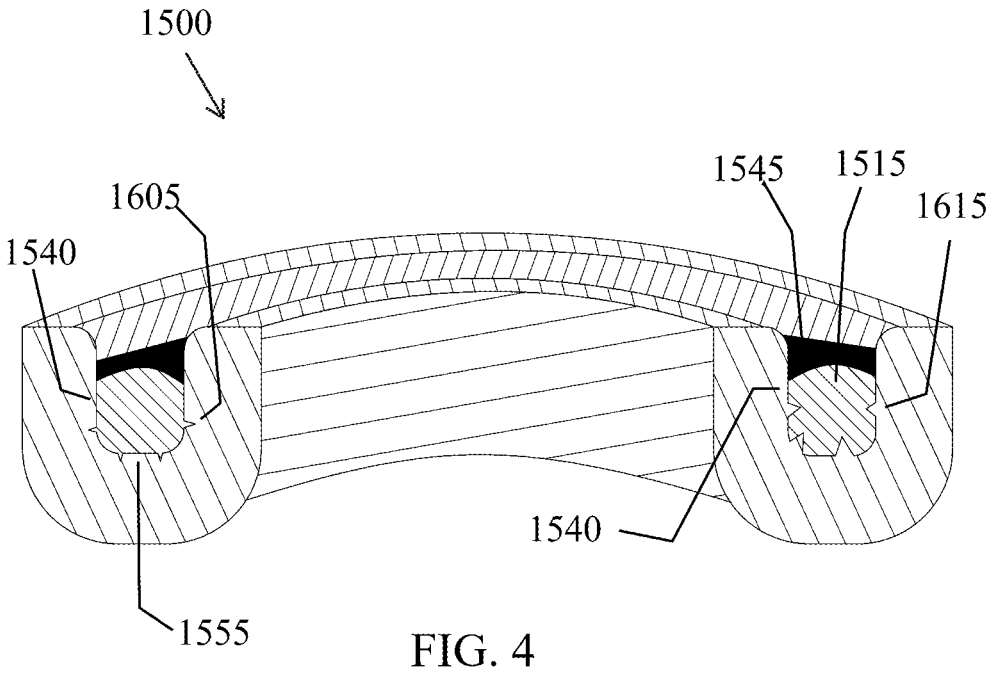
FIG. 4 is a diagram of a half section of an annular mold and ingot depicting cleats.
Figure 5:
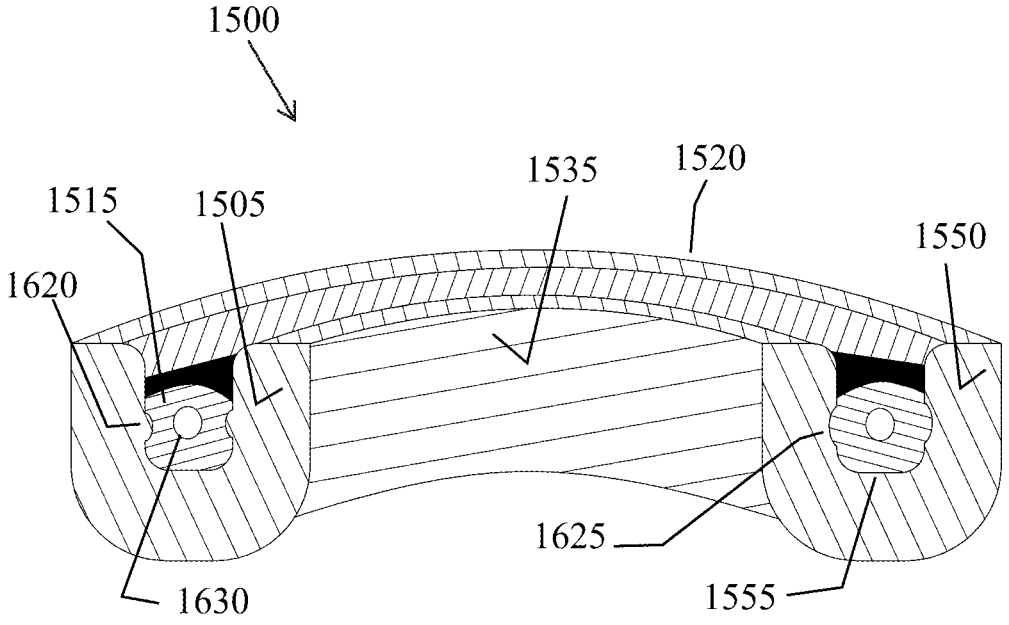
FIG. 5 is a diagram of a half section of an annular mold and ingot depicting flutes and annular internal passageway.

Relative to FIGS. 1 through 5, this application discloses an inductive coupler trough or mold 1500 and a method for producing the inductive coupler mold or trough 1500 for use in a downhole tool such as a drillpipe or bottom hole assembly. See (Prior Art) FIG. 6. The mold 1500 may comprise an annular magnetically conductive electrically insulating (MCEI) U-shaped single piece trough or mold 1500 comprising an annular channel comprising side walls 1540 and a bottom wall 1555. The MCEI mold comprises inner diameter 1535 and an outer diameter 1520 and inner and outer top surfaces 1530 and 1525, respectively. The annular channel 1540/1555 may comprise a first perforation 1640 and one or more second perforations 1580. Typically, inductive couplers for use in downhole applications may be comprised of multiple MCEI trough segments arranged end for end to form an annular ring-like structure. See (Prior Art) FIG. 15. The MCEI segments may be composed of a ferrite composition. Ferrite may be hard and brittle and susceptible to breakage. The use of segments may enable construction and handling of the MCEI coupler and reduce breakage of the ferrite ring. In this application, a solid MCEI ferrite ring 1500 may be used, a half section of which, between section surfaces 1505 and 1550 is diagramed in FIGS. 1-5, at 1500. The ferrite trough or mold 1500 may comprise an annular channel 1540/1555. The ferrite trough or MCEI ring 1500 may be used as a mold and an annular electrically conducting molten ingot 1515 may be cast within the annular channel 1540/1555 of the mold 1500. The ingot 1515 may produce an electromagnetic field when energized suitable for transmitting data to an electromagnetic field produced by a similarly configured nearby ingot. A molten metal comprising an electrically conducting metal or a metal alloy may be cast into the MCEI mold 1500 producing the electrically conducting ingot 1515. Ferrite segments may be used as a mold, also, by lining the channel with a thin refractory liner, such as a ceramic liner or a titanium or other metal foil, to prevent molten metal leakage between the segments.

The ingot 1515 may comprise a first end 1590 and a second end 1585, as diagramed through cut away 1595. A first socket 1570 may be cast in the ingot 1515 adjacent the first end 1590. One or more second sockets 1635 may be cast in the ingot 1515 adjacent the second end 1585. The sockets 1635/1570 may be cast when the ingot 1515 is cast in the channel or the sockets may be formed after the ingot is cast by machining. A first perforation 1640 and one or more second perforations 1580 may be formed in the bottom 1555 of the annular channel. The perforations 1640/1580 may be formed by machining after the ingot 1515 is cast into the channel of the mold 1500. The first perforation 1640 may be aligned with the first socket 1570 and the one or more second perforations 1580 may be aligned with the one or more second sockets 1635. The respective sockets may house electrical connections 1565. The first socket 1570 may house an electrical connection to a ground pin 1600 in the downhole tool. The one or more second sockets 1635 may house electrical connections 1565 to cables within the downhole tools. The cables may be connected to electronic equipment in the drill string or downhole tool. One or more cables may be attached to a similarly configured inductive coupler at the opposite end of the drill pipe or within the downhole tool. The alignment of the perforations 1640/1580 with the respective sockets allows for cable access through the MCEI mold to the make an electrical connection with the ingot 1515.

The channel 1540/1555 in the MCEI mold 1500 may comprise one or more cleats 1615 projecting into the ingot 1555 thereby securing the ingot within the channel. The ingot 1555 may comprise one or more cleats 1605 projecting into the channel as a means of securing the ingot within the channel. The ingot 1515 may comprise annular flutes 1620 and the channel also may comprise annular flutes 1625. The annular flutes of the ingot 1620 may couple with the annular flutes of the channel 1625. The annular flutes may assist in securing the ingot within the annular channel. Also, the annular flutes may increase the surface area of the ingot thereby increasing the strength of the electromagnetic field between adjacent inductive couplers. The ingot 1515 may comprise an annular internal passageway 1630 within the ingot 1515. The passageway 1630 may contribute resiliency to the ingot. Also, the passageway 1630 may promote rigidity in the ingot. An electrical cable, not shown, may run through the passageway 1630.

A nonelectrically conductive seal 1545 may enclose the ingot 1515 within the channel. A seal seat 1560 may be provided in the wall 1540 of the channel to seal the ingot 1515 from downhole fluids and other contamination and to fix the seal 1545 over the ingot. The seal 1545 may act as a channel filler protecting the ingot 1515 from contamination from the downhole environment. Also, seals 1575 may be provided for the respective sockets and electrical connections, sealing the ingot and the respective sockets and electrical connections against downhole contamination.

The inductive coupler may be produced by providing an annular MCEI U-shaped mold 1500 comprising an annular channel 1540/1555 and casting an electrically conductive molten metal or metal alloy into the channel, thereby producing an annular electrically conducting ingot 1515.

The ingot 1515 may have a first end 1590 and a second end 1585. A first socket 1570 may be formed proximate the first end and a second socket 1635 may be formed proximate the second end. The respective sockets may be formed when the molten metal is cast into the channel, or the respective sockets may be formed by machining after the ingot has cooled. The ingot may comprise one or more second sockets 1635. The sockets may provide a housing for electrical connections to the ingot 1515.

A first perforation 1640 and one or more second perforations 1580 may be formed in the channel by machining. The respective perforations may be aligned with the respective sockets. The perforations allow cables within the downhole tool or drill string to access electrical connections in the ingot. The first electrical connection 1600 may be to a ground pin within the downhole tool. The one or more second electrical connections 1565 may be to cables connecting the ingot to a similarly configured ingot at the opposite of the drill pipe, and the cables may connect the ingot 1515 to electronics and electrical equipment within the downhole tool.

Seals may be provided to protect the ingot and electrical connections within the channel. A seal 1545 may be provided to cover the ingot within the channel. The channel seal 1545 may be partially disposed within annular seal seats 1560 formed in the walls 1540 of the channel. The respective sockets may be provided with seals 1575 to prevent contamination from downhole fluids and debris.

The ingot 1515 may be provided with an annular passageway 1630 that may be formed within the ingot by placing a tubular form, not shown, in the channel prior to casting in the molten metal. The tubular form may be electrically conductive and remain within the ingot or it may be nonelectrically conductive and consumed in the process.

Cleats 1605/1615 and flutes 1620/1625 may be formed in the channel and in the ingot, respectively. The cleats and flutes may be formed in the channel before it is sintered or machined in after sintering. Also, the flutes and cleats may be formed in the ingot when the ingot is cast into the channel by providing a form in the channel comprising the flutes and cleats. The form may be permanent or may be a consumable.

The remainder of the detailed description relates to the prior art figures of the '865 reference. The teachings of the prior art figures are applicable to this disclosure except when modified by this disclosure.

Referring to (Prior Art) FIG. 6, one embodiment of a downhole drilling system 10 for use with the present invention includes a tool string 12 having multiple sections of drill pipe and other downhole tools. The tool string 12 is typically rotated by a drill rig 14 to turn a drill bit 16 that is loaded against a formation 18 to form a borehole 20. Rotation of the drill bit 16 may alternatively be provided by other downhole tools such as drill motors or drill turbines located adjacent to the drill bit 16.

The tool string 12 includes a bottom-hole assembly 22 which may include the drill bit 16 as well as sensors and other downhole tools such as logging-while-drilling ("LWD") tools, measurement-while-drilling ("MWD") tools, diagnostic-while-drilling ("DWD") tools, or the like. The bottom-hole assembly 22 may also include other downhole tools such as heavyweight drill pipe, drill collar, crossovers, mud motors, directional drilling equipment, stabilizers, hole openers, sub-assemblies, under-reamers, drilling jars, drilling shock absorbers, and other specialized devices.

While drilling, a drilling fluid is typically supplied under pressure at the drill rig 14 through the tool string 12. The drilling fluid typically flows downhole through a central bore of the tool string 12 and then returns up-hole to the drill rig 14 through an annulus 20 about the tool string 12. Pressurized drilling fluid is circulated around the drill bit 16 to provide a flushing action to carry cuttings to the surface.

To transmit information at high speeds along the tool string 12, a telemetry network comprising multiple network nodes 24 may be integrated into the tool string 12. These network nodes 24 may be used as repeaters to boost a data signal at regular intervals as the signal travels along the tool string 12. The nodes 24 may also be used to interface with various types of sensors to provide points for data collection along the tool string 12. The telemetry network may include a top-hole server 26, also acting as a network node, which may interface with the tool string 12 using a swivel device 28 for transmitting data between the tool string 12 and the server 26. The top-hole server 26 may be used to transfer data and tool commands to and from multiple local and remote users in real time. To transmit data between each of the nodes 24 and the server 26, data couplers and high-speed data cable may be incorporated into the drill pipe and other downhole tools making up the tool string 12. In selected embodiments, the data couplers may be used to transmit data across the tool joint interfaces by induction and without requiring direct electrical contact between the couplers.

One embodiment of a downhole telemetry network is described in U.S. Pat. No. 6,670,880 entitled Downhole Data Transmission System, having common inventors with the present invention, which this specification incorporates by reference. The telemetry network described in the above-named application enables high-speed bi-directional data transmission along the tool string 12 in real-time. This provides various benefits including but not limited to the ability to control downhole equipment, such as rotary steerable systems, instantaneously from the surface. The network also enables transmission of full seismic waveforms and logging-while-drilling images to the surface in real time and communication with complex logging tools integrated into the tool string 12 without the need for wireline cables. The network further enables control of downhole tools with precision and in real time, access to downhole data even during loss of circulation events, and monitoring of pressure conditions, hole stability, solids movement, and influx migration in real time. The use of the abovementioned equipment may require the ability of passing power between segments of the tool string 12.

Referring now to (Prior Art) FIG. 7, a downhole tool string component 200 of the tool string 12 of (Prior Art) FIG. 6 comprises a tubular body 201A with a box end 202A and a pin end 203A, with each end 202A, 203A being adapted for threaded connection to an adjacent tool string component (not shown). Both ends 202A, 203A have a shoulder 204A that is adapted to abut an adjacent shoulder of an adjacent end of the adjacent tool string component. The downhole tool string component 200A may have a plurality of pockets 205A. The pockets 205A may be formed by a plurality of flanges 206A disposed around the downhole tool string component 200A at different axial locations and covered by individual sleeves 207A disposed between and around the flanges 206A. A pocket 205A may be formed around an outer surface of the tubular body 201A by a sleeve 207A disposed around the tubular body 201A such that opposite ends of the sleeve 207A fit around at least a portion of a first flange 206A and a second flange 206A. The sleeves 207A may be interlocked or keyed together near the flanges 206A for extra torsional support. At least one sleeve 207A may be made of a non-magnetic material, which may be useful in embodiments using magnetic sensors or other electronics. The pockets 205A may be sealed by a sleeve 207A.

Electronic equipment may be disposed within at least one of the pockets 205A of the downhole tool string component 200A. The electronics may be in electrical communication with the aforementioned telemetry system, or they may be part of a closed-loop system downhole. An electronic device 210A is secured to the tubular body 201A and may be disposed within at least one of the pockets 205A, which may protect the device 210A from downhole conditions. The electronic device 210A may comprise sensors for monitoring downhole conditions. The sensors may include pressure sensors, strain sensors, flow sensors, acoustic sensors, temperature sensors, torque sensors, position sensors, vibration sensors, geophones, hydrophones, electrical potential sensors, nuclear sensors, or any combination thereof. In some embodiments of the invention the electronic device 210A may be a sensor, drill instrument, logging-while drilling tool, measuring-while drilling too, computational board, or combinations thereof. Information gathered from the sensors may be used either by an operator at the surface or by the closed-loop system downhole for modifications during the drilling process. If electronics are disposed in more than one pocket 205A, the pockets 205A may be in electrical communication, which may be through an electrically conductive conduit disposed within the flange separating them. The information may be sent directly to the surface without any computations taking place downhole. In some embodiments the electronic device may be a sonic tool. The sonic tool may comprise multiple poles and may be integrated directly into the tool string. Sending all of the gathered information from the sonic tool directly to the surface without downhole computations may eliminate the need for downhole electronics which may be expensive. The surface equipment may in some cases by able to process the data quicker since the electronics up-hole is not being processed in a high temperature, high pressure environment.

Referring now to (Prior Art) FIG. 8 and (Prior Art) FIG. 8A, (Prior Art) FIG. 8 discloses a pin end 203B of an embodiment of a downhole tool string component 200B having a plurality of annular recesses 301B formed in a shoulder 204B. In some embodiments the shoulder 204B may comprise a single recess 301B. An annular inductive coupler 302 is disposed within each recess 301B and comprises a coil 303B. A first inductive coupler 304B may be optimized for the transfer of power and a second inductive coupler 305B may be optimized for the transfer of data. Referring to the coil 303B disposed in the first coupler 304B, the coil 303B is in electrical communication with the electronic device 210B via an electrical conductor 306B. An electrical circuit 307B comprises the electronic device 210B, the annular coil 303B disposed in the first coupler 304B, and two electrical conductors 306B that are disposed intermediate, or between, the electronic device 210B and the coil 303B and which are in electrical communication with both the electronic device 210B and the coil 303B. A portion 308B of the electrical circuit 307B comprises the coil 303B and the two electrical conductors 306B, and in some embodiments may not comprise the electronic device 210B. The portion 308B is electrically isolated from the tubular body 201B of the component 200B.

(Prior Art) FIGS. 9 and 10 respectively disclose a perspective view and an exploded view of an embodiment of an inductive coupler 302C. The inductive coupler 302C comprises a housing ring 401C, a first lead 402C and a second lead 403C. The housing ring 401C may comprise a durable material such as steel. In the present embodiment the first lead 402C and the second lead 403C are proximate one another. The first lead 402C and the second lead 403C are adapted to electrically communicate with electrical conductors such as the two electrical conductors 306B disclosed in (Prior Art) FIG. 8. In the embodiments of (Prior Art) FIGS. 9 and 10, the leads 402C, 403C and their corresponding electrical conductors are disposed proximate one another. The inductive coupler 302C also comprises a coil 303C and an annular trough 404C made of magnetic material. The magnetic material may comprise a composition selected from the group consisting of ferrite, a nickel alloy, a zinc alloy, a manganese alloy, soft iron, a silicon iron alloy, a cobalt iron alloy, a mu-metal, a laminated mu-metal, barium, strongtium, carbonate, samarium, cobalt, neodymium, boron, a metal oxide, rare earth metals, Fe, Cu, Mo, Cr, V, C, Si, molypermalloys, metallic powder suspended in an electrically insulating material, and combinations thereof. The magnetic material may comprise a relative magnetic permeability of between 100 and 20000. The coil 303C may comprise an electrically conductive material such as copper. When an alternating electrical current is passed through the coil 303C an inductive signal may be generated. The coil 303C may comprise a characteristic of increasing less than 35 degrees Celsius (.degree. C.) when 160 watts of power are passed through the coil 303. In some embodiments the coil 303 may increase less than 20.degree. C. when 160 watts are passed through it.

Referring now to (Prior Art) FIGS. 11-13, inductive coupler 302D comprises a coil 303D having a plurality of windings 601D of wire strands 602D that are each electrically isolated from one another. The wire strands 602D are disposed in the annular trough 404D of magnetic material that is secured within the annular recess 301D. As disclosed in (Prior Art) FIGS. 12 and 13, the wire strands 602D may be interwoven. In some embodiments each coil 303D may comprise between 5 and 40 wire strands 602D and between 1 and 15 coil turns. In the present application, windings 601D and coil turns may be used interchangeably. The coil 303D may comprise a gauge between 36 and 40 American Wire Gauge (AWG). In the present embodiment a first lead 402 and a second lead 403 of the inductive coupler 302D and their corresponding electrical conductors are disposed on opposite sides of the inductive coupler 302D. In some embodiments, the wire strands 602D are collectively wrapped with an insulator and in some embodiments, no insulator is required. A filler material such as Teflon®, (i.e. polytetrafluoroethlyene, fluoropolymer, and other fluoropolymers) or an epoxy may be used to fill the gaps in the inductive couplers 302D, such as the gaps between the coil 303D and the annular trough 404D, and the annular trough 404D and the annular recess 301D, and so forth.

(Prior Art) FIG. 14 discloses an embodiment of a downhole drill string component 200E in which an electronic device 210E is a computational board 901E. The computational board 901E is in electrical communication with both a first lead 402E and a second lead 403E of the inductive coupler 302E through an electrical conductor 306E. The computational board 901E may send and receive electrical signals to and from other electrical equipment associated with the drilling operation through the downhole network.

(Prior Art) FIG. 15 is a perspective diagram of an inductive coupler 302F in which a first lead 402F and a second lead 403F are proximate one another. (Prior Art) FIG. 15 also shows an embodiment in which an annular trough 404F of magnetic material comprises a plurality of segments 1001F of magnetic material that are each disposed intermediate, or between, the coil 303F and the ring housing 401F.

Referring now to (Prior Art) FIG. 16, an embodiment is shown in which a downhole component 200G is connected at its box end 202G to a pin end 203G of an adjacent tool string component 1101G. The adjacent tool string component 1101G comprises an adjacent inductive coupler 1102G that is configured similar to the inductive coupler 302G of the downhole tool string component 200G. The inductive couplers 302G, 1102G are adapted to couple when the components 200G, 1101G are connected together at their ends 202G, 203G. The inductive couplers 302G, 1102G are adapted to induce magnetic fields in each other when their coils 303G are electrically energized. Specifically, passing an alternating electrical current through the coil 303G of either inductive coupler 302G, 1102G, induces a magnetic field in the other coupler 1102G, 302G. This induced magnetic field is believed to induce an alternating electrical current in the induced coil 303G. In some embodiments, when 160 watts are passed through one of the couplers 302G, 1102G, at least 136 watts are induced in other coupler 1102G, 302G. In other words, the inductive coupler 302G may comprise a characteristic of transferring at least 85% of its energy input into the adjacent coupler 1102G. In some embodiments the inductive coupler 302G may transfer at least 95% of its input energy into the adjacent coupler 1102G.

(Prior Art) FIG. 16 also discloses tool string components 200G, 1101G comprising both primary and secondary shoulders 1103G, 1004G. In the present embodiment an inductive coupler 302G is disposed in each of the primary and secondary shoulders 1103G, 1004G. In some embodiments only the primary shoulder 1103G or only the secondary shoulder 1104G may comprise a inductive coupler 302G. In embodiments where each of the primary and secondary shoulders 1103G, 1004G comprises a inductive coupler 302G, each inductive coupler 302G may transfer energy at a different optimal frequency. This may be accomplished by providing the first and second coils 303G with different geometries which may differ in the number of windings 601G, diameter, type of material, surface area, length, or combinations thereof. The annular troughs 404G of the couplers 302G, 1102G may also comprise different geometries as well. The inductive couplers 302G, 1102G may act as band pass filters due to their inherent inductance, capacitance and resistance such that a first frequency is allowed to pass at a first resonant frequency, and a second frequency is allowed to pass at a second resonant frequency. Preferably, the signals transmitting through the electrical conductors 306G may have frequencies at or about at the resonant frequencies of the band pass filters. By configuring the signals to have different frequencies, each at one of the resonant frequencies of the couplers 302G, the signals may be transmitted through one or more tool string components and still be distinguished from one another. In (Prior Art) FIG. 16, the coils 303G disposed in the inductive couplers 302G in the primary and secondary shoulders 1103G, 1104G of the tool string component each comprise a single winding 601G, while the coils 303G disposed in the adjacent inductive couplers 1102G in the primary and secondary shoulders 1103G, 1004G of the adjacent component 1101G each comprise three windings 601G. Other numbers and combinations of windings 601G may be consistent with the present invention.

Referring now to (Prior Art) FIG. 17, an embodiment of a downhole network 17H in accordance with embodiment of the invention is disclosed comprising various electronic devices 210H spaced at selected intervals along the network 17H. Each of the electronic devices 210H may be in operable communication with a bottom-hole assembly 22H based on power and/or data transfer to the electronic devices 210H. As power or data signals travel up and down the network 17H, transmission elements 86Ha-86He may be used to transmit signals across tool joints of a tool string 12H. Transmission elements 86Ha-86He may comprise an inductive coupler 302H coupled with an adjacent inductive coupler 1102H. Thus, a direct electrical contact is not needed across a tool joint to provide effective power coupling. In selected embodiments, when using transmission elements 86Ha-86He, consistent spacing should be provided between each transmission element 86Ha-86He to provide consistent impedance or matching across each tool joint. This may help to prevent excessive power loss caused by signal reflections or signal dispersion at the tool joint.

(Prior Art) FIG. 18 discloses an embodiment in which the electronic device 210J is a power source 1301J. In (Prior Art) FIG. 18 the power source 1301J is a battery 1302J. The battery 1302J may store chemical potential energy within it. Because downhole sensors, tools, telemetry and other electronic components require power to operate, a need exists for a reliable energy source to power downhole components. In some embodiments, the power source 1301J may comprise a battery, generator, capacitor, motor, or combinations thereof. A downhole electric power generator may be used to provide power to downhole components. In certain embodiments, the generator may be a micro-generator mounted in the wall of a downhole tool to avoid obstructing the tool's central bore.

In general, a downhole generator in accordance with the invention may include a turbine mechanically coupled to an electrical generator. The turbine may receive a moving downhole fluid, such as drilling mud. This downhole fluid may turn blades of the turbine to produce rotational energy (e.g., by rotating a shaft, etc.). This rotational energy may be used to drive a generator to produce electricity. The electrical power produced by the generator may be used to power electrical equipment such as sensors, tools, telemetry components, and other electronic components. One example of a downhole generator which may be used with the present invention is described in U.S. Pat. No. 7,190,084 which is herein incorporated by reference in its entirety. Preferably, however, the turbine is disposed within the bore of the drill string.

Downhole generators may be AC generators that are configured to produce an alternating current with a frequency between about 100 Hz and 2 kHz. More typically, AC generators are configured to produce an alternating current with a frequency between about 300 Hz and 1 kHz. The frequency of the alternating current is proportional to the rotational velocity of the turbine and generator. In some embodiments of the invention, a frequency converter may alter the frequency from a range between 300 Hz and 1 kHz to a range between 10 kHz and 100 kHz. In certain embodiments, an alternating current with a frequency between about 10 kHz and 100 kHz may achieve more efficient power transmission across the tool joints. Thus, in selected embodiments, the frequency of the alternating current produced by the generator may be shifted to a higher frequency to achieve more efficient power transmission.

To achieve this, a rectifier may be used to convert the alternating current of the generator to direct current. An inverter may convert the direct current to an alternating current having a frequency between about 10 kHz and 100 kHz. The inverter may need to be a custom design since there may be few if any commercially available inverters designed to produce an AC signal between about 400 Hz and 1 MHz. The alternating current at the higher frequency may then be transmitted through electrical conductors 306 routed along the tool string 12. The power signal may be transmitted across tool joints to other downhole tools by way of the transmission elements 86 discussed in the description of (Prior Art) FIG. 17.

In selected embodiments, a gear assembly may be provided between the turbine and the generator to increase the rotational speed of the generator relative to the turbine. For example, the gear assembly may be designed such that the generator rotates between about 1.5 and 10 times faster than the turbine. Such an increase in velocity may be used to increase the power generated by the generator as well as increase the frequency of the alternating current produced by the generator. One example of an axially mounted downhole generator that may be used with the present invention is described in patent application Ser. No. 11/611,310 and entitled, "System for steering a tool string," which has common inventors with the present invention and which this specification incorporates by reference for all that it contains.

Referring now to (Prior Art) FIG. 19, a flowchart illustrates a method 1400 of transferring power from a downhole tool string component 200 to an adjacent tool string component 1101. The method 1400 comprises a step 1401 of providing a downhole tool string component 200 and an adjacent tool string component 1101 respectively comprising an annular inductive coupler 302 and an adjacent annular inductive coupler 1102. Each coupler 302, 1102 is disposed in an annular recess 301 in a shoulder 204 of an end 202, 203 of one of the components 200, 1101. The method 1400 further comprises a step 1402 of adapting the shoulder 204 of each of the downhole tool string component 200 and the adjacent tool string component 1101 to abut one another when the ends 202, 203 of the components 200, 1101 are mechanically connected to one another. The method 140 further comprises a step 1403 of mechanically connecting the ends 202, 203 of the components 200, 1101 to one another, and a step 1404 of driving an alternating electrical current through the inductive coupler 302 at a frequency of between 10 and 100 kHz. In some embodiments, the alternating electrical current is a square wave.

In some embodiments the alternating electrical current may be driven at a frequency between 50 and 70 kHz. The inductive couplers 302, 1102 may each be disposed within an annular trough 404 of magnetic material. The troughs 404 may each be disposed within an annular recess 301 of the tool string components 200, 1101. At least one of the inductive couplers 302, 1102 may comprise a coil 303 that comprises a plurality of windings 601 of wire strands 602. The wire strands 602 may each be electrically isolated from each other. In some embodiments at least 85% of the energy comprised by the alternating electrical current being driven through the annular inductive coupler 302 may be inductively transferred to the adjacent inductive coupler 1102 when 160 watts are passed through the coil 303 of the inductive coupler 302. In some embodiments at least 95% of the energy may be inductively transferred when 160 watts are passed through the coil 303.

Whereas the present invention has been described in particular relation to the drawings attached hereto, it should be understood that other and further modifications apart from those shown or suggested herein, may be made within the scope and spirit of the present invention.

The invention claimed is:

1. An inductive coupler and method for a downhole tool, comprising:

an annular magnetically conductive and electrically insulating, MCEI, U-shaped mold comprising segments forming an annular channel comprising a first perforation through a selected segment and one or more second perforations through additional segments;

an annular electrically conducting molten metal being cast within the annular channel forming an ingot within the annular channel;

the ingot comprising a first end and a second end, wherein a first closed-end blind socket in the ingot adjacent the first end is aligned with the first perforation in the selected segment and one or more second closed-end blind sockets in the ingot are aligned with the one or more second perforations in the additional segments.

2. The inductive coupler of claim 1, wherein the channel comprises cleats projecting into the ingot.

3. The inductive coupler of claim 1, wherein the ingot comprises cleats projecting into the channel.

4. The inductive coupler of claim 1, wherein the first socket comprises a first electrical connection between the ingot and a ground pin in the downhole tool projecting through the first perforation.

5. The inductive coupler of claim 1, wherein the second sockets comprise one or more second electrical connections between the ingot and one or more electrical cables within the downhole tool projecting through the second perforations and electrically connecting the ingot with a similarly configured ingot within the downhole tool.

6. The inductive coupler of claim 1, wherein the second socket comprises a second electrical connection between the ingot and an electrical cable projecting through the second perforation and electrically connecting the ingot with electronics within the downhole tool.

7. The inductive coupler of claim 1, wherein the ingot and the annular channel each comprise annular flutes.

8. The inductive coupler of claim 7, wherein the annular flutes of the annular channel project inwardly from the annular channel and the annular flutes of the ingot project outwardly from the ingot.

9. The inductive coupler of claim 8, wherein the annular flutes of the ingot couple with the annular flutes of the annular channel.

10. The inductive coupler of claim 1, wherein the ingot comprises an annular internal passageway.

11. The inductive coupler of claim 1, wherein the channel comprises a nonelectrically conductive seal seat and seal adjacent to the ingot.

12. The inductive coupler of claim 1, wherein the respective sockets comprise a seal between the ingot and the respective electrical connections.

13. A method for producing an inductive coupler for a downhole tool, comprising:

providing an annular MCEI U-shaped ferrite mold comprising an annular channel;

providing a thin liner within the annular channel;

providing a molten metal or molten metal alloy;

casting the molten metal or metal alloy into the lined annular channel forming an ingot within the annular channel, providing the ingot with a first end and a second end, and casting a first closed-end blind socket in the ingot proximate the first end and casting one or more second closed-end blind sockets in the ingot proximate the second end.

14. The method of claim 13, providing a first perforation and one or more second perforations formed in the channel, the respective perforations being aligned with the respective sockets.

15. The method of claim 13, providing an electrical connection to ground within the downhole tool disposed within the first socket.

16. The method of claim 13, providing an electrical connection to a cable within the downhole tool disposed within the one or more second sockets.

17. The method of claim 13, providing the respective sockets comprise a seal.

18. The method of claim 13, providing an annular passageway formed within the ingot.

19. The method of claim 13, providing cleats cast in the ingot and formed in the channel.

20. The method of claim 13, providing flutes cast in the ingot that couple with flutes formed in the channel.

* * * * *